US007261524B2

(12) United States Patent
Marioni

(10) Patent No.: US 7,261,524 B2
(45) Date of Patent: Aug. 28, 2007

(54) ROTATION SUPPORT WITH IMPROVED THRUST-BEARING FOR ROTORS OF PUMP ELECTRIC MOTORS

(75) Inventor: Elio Marioni, Dueville (IT)

(73) Assignee: Askoll Holding S.r.l., Povolaro di Dueville (IT)

( * ) Notice: Subject to any disclaimer, the term of this patent is extended or adjusted under 35 U.S.C. 154(b) by 0 days.

(21) Appl. No.: 11/171,639

(22) Filed: Jun. 30, 2005

(65) Prior Publication Data

US 2006/0034716 A1 Feb. 16, 2006

(30) Foreign Application Priority Data

Jun. 30, 2004 (EP) ..... 04425484

(51) Int. Cl.
*F04B 17/00* (2006.01)
*F04B 35/00* (2006.01)

(52) U.S. Cl. ..... 417/360; 417/321; 417/322; 417/410.1

(58) Field of Classification Search ..... 417/360, 417/410.1, 321, 322
See application file for complete search history.

(56) References Cited

U.S. PATENT DOCUMENTS 3,220,350 A 11/1965 White ..... 103/87
4,869,654 A 9/1989 Klaus ..... 417/360
4,967,111 A * 10/1990 Andrieux et al. ..... 310/90
4,998,863 A * 3/1991 Klaus ..... 417/63
5,280,210 A * 1/1994 Kress et al. ..... 310/158
5,668,425 A * 9/1997 Marioni et al. ..... 310/162
5,895,203 A 4/1999 Klein ..... 415/122.1
6,271,638 B1 * 8/2001 Erdman et al. ..... 318/439
6,384,508 B1 * 5/2002 Marioni ..... 310/261
6,452,383 B1 * 9/2002 Goedecke ..... 324/207.22

* cited by examiner

*Primary Examiner*—Anthony D. Stashick
*Assistant Examiner*—Ryan Gillan
(74) *Attorney, Agent, or Firm*—Seed IP Law Group PLLC

(57) ABSTRACT

A rotation support has improved thrust-bearing for rotors of electric motors of synchronous pumps. The rotation sup: a stator of the electric motor, in which a hollow body is housed for supporting and containing a permanent magnet rotor, an impeller being kinematically coupled with a shaft of the electric motor, as well as opposite supports of the shaft, one of which is provided with axial thrust-bearing. Advantageously, the support provided with thrust-bearing comprises a bush of antifriction material facing a side of the rotor and which has an axial abutment placed directly in contact with this side of the rotor.

14 Claims, 3 Drawing Sheets

ROTATION SUPPORT WITH IMPROVED THRUST-BEARING FOR ROTORS OF PUMP ELECTRIC MOTORS

BACKGROUND OF THE INVENTION

1. Field of the Invention

The present invention relates to a rotation support with improved thrust-bearing for rotors of pump electric motors, i.e., a new way of supporting the axial thrusts generated in the fluid circulation pumps in order to make the production easier and to make the use and maintenance functional.

More in particular the invention relates to a rotation support for pump motors comprising a stator of the electric motor, in which a hollow body is housed for supporting and containing a permanent magnet rotor, an impeller being kinematically coupled with a shaft of the electric motor, as well as opposite shaft supports, one of which is provided with axial thrust-bearing.

2. Description of the Related Art

As it is well known to the technicians in the field, fluid circulation pumps comprise an electric motor whose rotor is keyed to a shaft, which carries, kinematically connected with an end, the impeller of the pump.

The pumps can have impellers of various form and scope of propulsion of the treated fluid; in the case of impellers with curve vanes of the centrifugal type, the pulse given to the fluid generates an axial thrust due to the pressure gradient which generates between the suction and delivery areas of the impeller. For the conformation of the pump, exactly of the centrifugal type, the above areas are always placed with the suction area belonging to the impeller in axis with the rotation shaft and the delivery in an annular region external to the diameter of the impeller and coplanar thereto.

This arrangement generates an axial thrust acting on the impeller, resulting from the axial component of the difference between the pressure field exiting upstream and downstream the impeller, such as to approach the suction mouth of the impeller towards the conduit which feeds the fluid.

In the typology of the motor pumps for fluids at issue in the present invention, motor pumps are known wherein the electric motor is of the synchronous type and the permanent magnet rotor is housed in a hollow body within the stator pack and the windings. The pack with the windings is separated and insulated from the hollow body for ensuring the electrical insulation, but the rotor is housed inside the stator pack in a extractable way for allowing an easy assembly and possible extraction for the maintenance.

In the technique, supporting the rotor with supporting bushes of antifriction material is known: the bush on the impeller side also supports the axial thrust transmitted from the impeller to the rotor by means of the driving shaft. The contact between the axial abutment of the supporting bush and the rotor occurs by means of a thrust-bearing disk of hard, abrasion-resistant material inserted between said axial abutment and the side of the motor. This disk is normally placed by means of an annular seat inserted and made integral with the driving shaft: the seat and the disk are axially blocked on the shaft in a suitable position for centering the rotor on the stator.

This disk, in a realization of Askoll Holding S.r.l., the assignee of the present application, is preferably placed by means of an annular cup of elastic material provided with a central convexity for allowing the adaptation of the disk to the abutment of the bush. The cup is further provided with engaging toothed edge of the external edge of the thrust-bearing disk.

The assembly of the disk and of the cup is housed in a suitable chamber realized on the side of the rotor by means of an extension of the plastic skirt of the rotor itself.

Therefore, in the state of the art, the support of the axial thrusts is known by means of the interposition of a suitable element, exactly the thrust-bearing disk, and of further accessory parts such as the containing annular seat and/or the annular cup of elastic material.

BRIEF SUMMARY OF THE INVENTION

One embodiment of the present invention transmits the axial thrust between the shaft/rotor and the axial abutment of the supporting bush by simplifying the construction, reducing the axial sizes, making it more practical the assembly and simplifying the maintenance of the axial thrust-bearing on the side of the impeller.

The embodiment realizes an axial thrust-bearing for pumps which can achieve the necessary axial thrust-bearing of the impeller with very reduced costs and by exploiting the economies of scale typical of the products realized on a large scale.

In one embodiment of the present invention, a rotation support is provided with thrust-bearing comprises a bush of antifriction material facing a side of the rotor and has an axial abutment placed directly in contact with said side of the rotor.

The characteristics and advantages of the pump provided with support according to the invention will be apparent from the following description of an embodiment given by way of indicative and non-limiting example with reference to the annexed drawings.

DETAILED DESCRIPTION OF THE INVENTION

Figure 1:
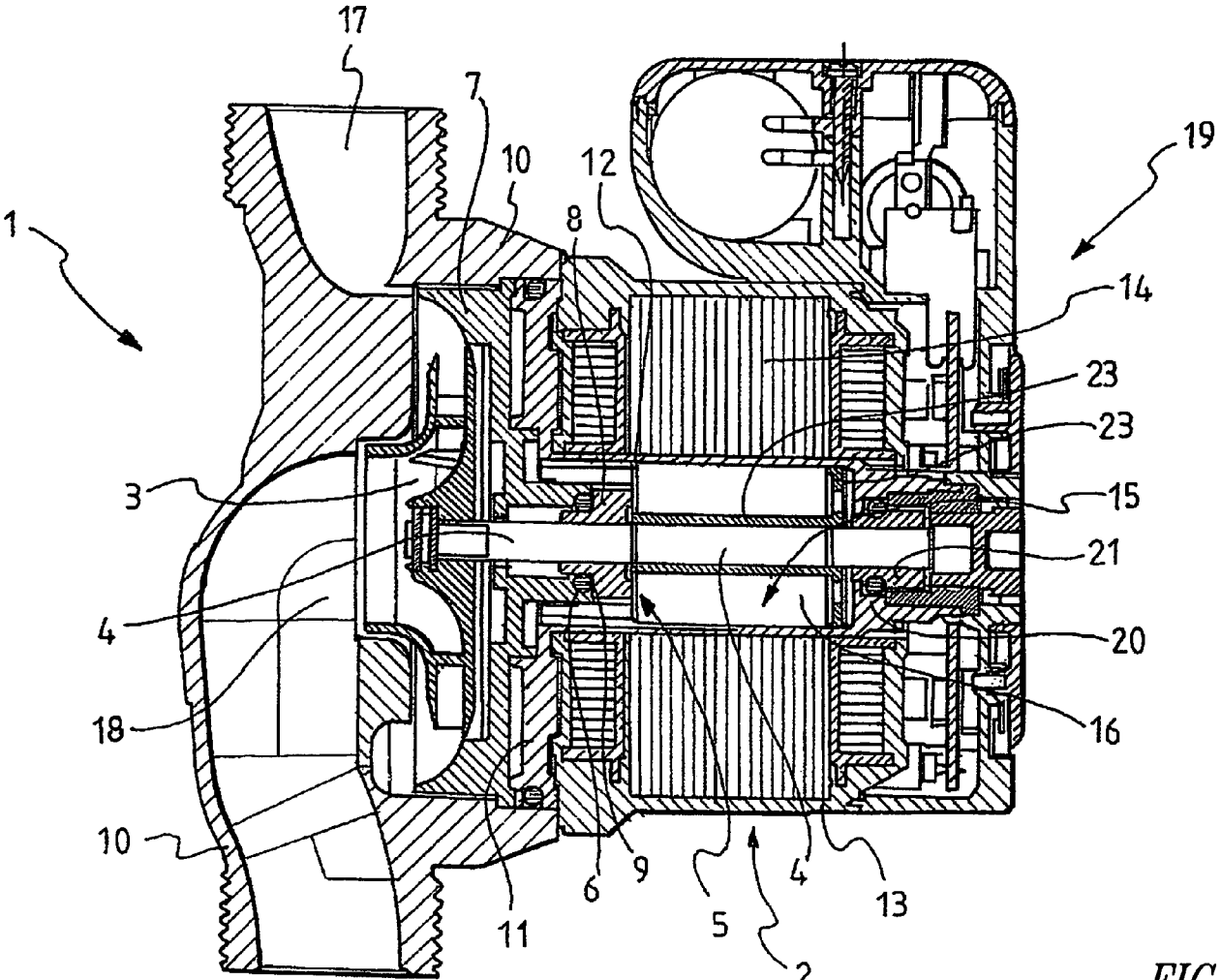
FIG. 1 shows a schematic, axial section of the motor pump provided with the support with improved thrust-bearing according to one embodiment of the invention, on the other hand shown with the relevant components of the control electronic circuit.

With reference to these figures, and in particular to the example of FIG. 1, 30 globally and schematically indicates a motor pump incorporating a rotation support 5 with thrust-bearing realized according to the present invention.

The motor pump 30 is realized by means of the coupling of a pump 1 and of an electric motor 2.

The pump 1 and the motor 2 have the same supports so that an impeller 3 of the pump is keyed to and rotably supported at one end of a shaft 4 of the electric motor.

Advantageously, a support 5 on the side of the impeller comprises a seat 6 integrally formed in a bush-carrying disk 7, of the impeller 3 for housing a bush 8 of antifriction material and an elastic ring 9 for suspending and adapting the bush 8 in the relevant seat 6; with a similar conformation of the rear bush, it allows, as it is known, the self-alignment of the rotation axis of the rotor with that of the supports.

A body 10 of the pump 1 is rigidly coupled, by means of a flange 11 of a hollow body 12, with a body 13 of the electric motor 2.

The electric motor 2 is advantageously of the synchronous type wherein a stator 14 is centrally crossed by the hollow body 12 for housing a rotor 15. The rotor is a permanent magnet 16 one and it is tightly insulated with respect to the stator 14 from the hollow body itself.

The rotor 15 is led into rotation by the electromagnetic field generated by the stator 14, provided with pole shoes with relevant windings.

The body 10 of the pump has a delivery opening 17 with axis being preferably orthogonal to the axis of the shaft 4 and it is placed tangentially to the impeller 3. The pump body also has a suction opening 18 wherefrom the fluid pumped by the impeller 3 is suctioned through the delivery opening. The suction opening 18 preferably has an axis being parallel to the axis of the shaft 4.

The electric motor is completed by the electronic components enclosed in a box 19 coupled with the body 13 of the electric motor on the opposite side of the pump 1.

The shaft 4 is supported on the opposite side of the impeller to said hollow body 12 which ends with a support 20 comprising an antifriction bush 21 realized in a known way.

The support 5 on the side of the impeller has the axial abutment of the bush 8 in contact with a first of two sides 23A, 23B of the rotor 15 wherein the magnets 16 emerge so that the contact occurs between said abutment and the first side 23A.

Advantageously, the material the magnets 16 are made of is magnetic ceramic ferrite provided with surface hardness being high enough so as to ensure the correct coupling with the abutment of the bush 8 of antifriction material, thus realizing a sliding axial thrust-bearing.

Figure 2:
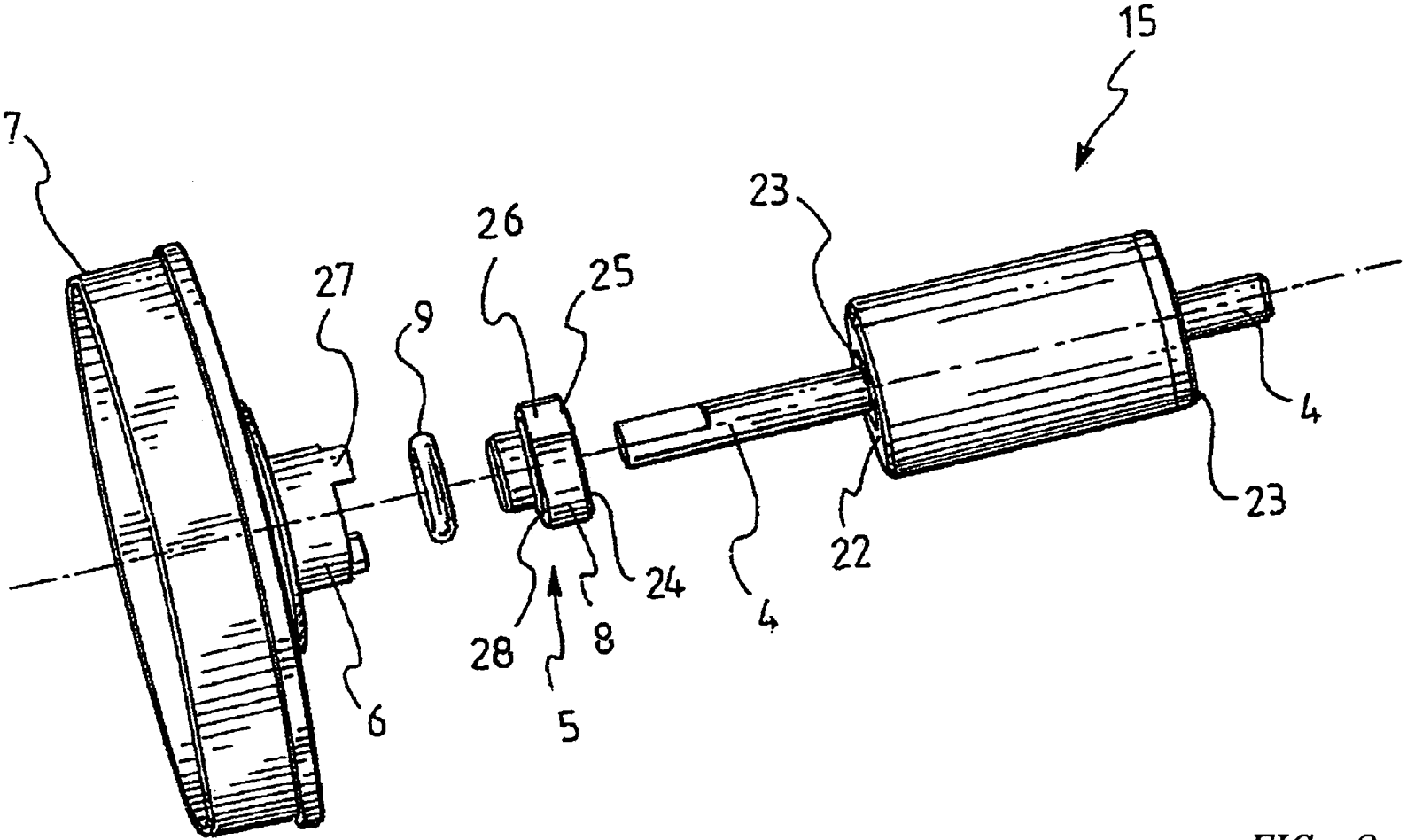
FIG. 2 shows a schematic, exploded view of the rotor and of the support of the support of the rotor with the thrust-bearing according to the invention.
Figure 3:
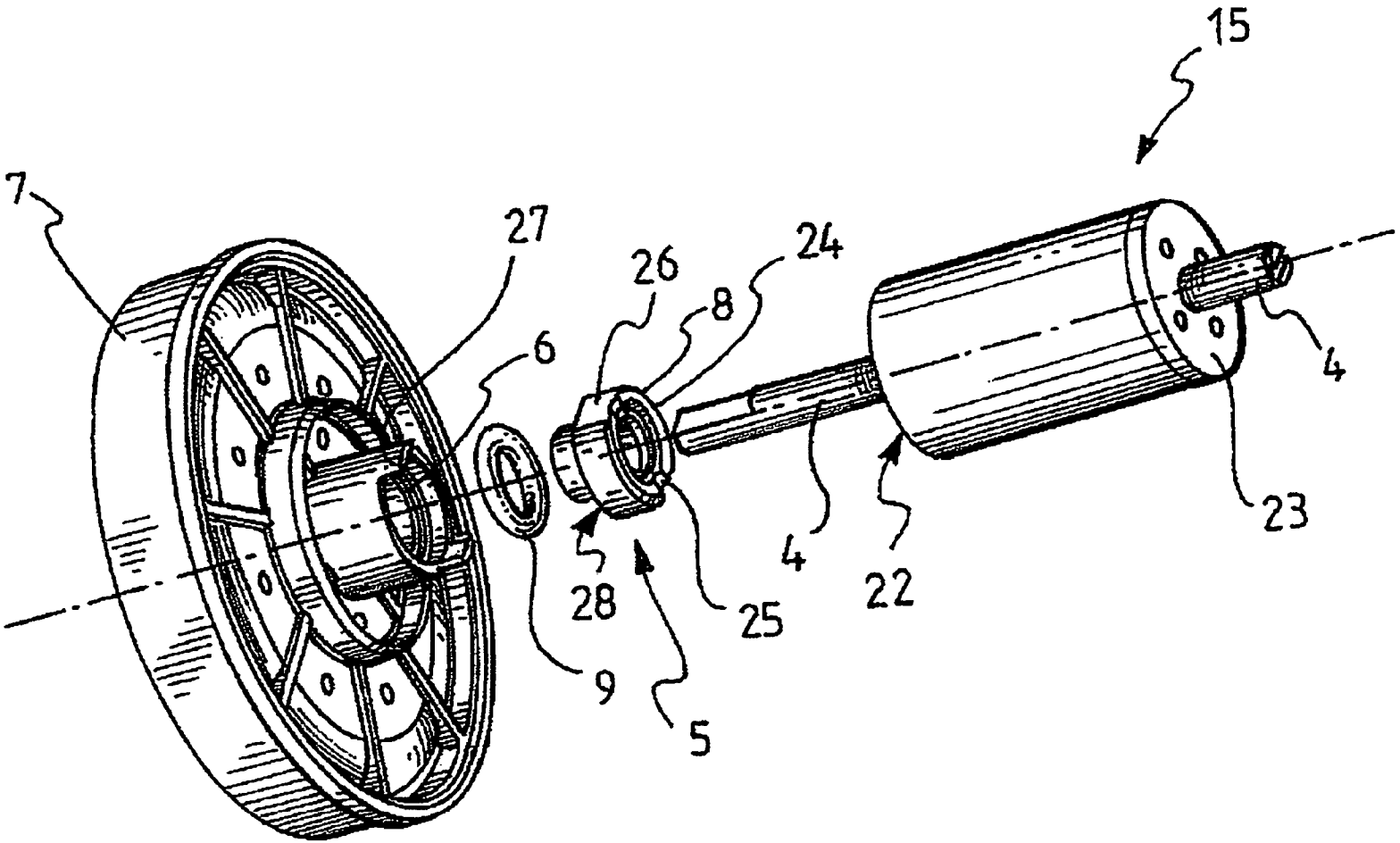
FIG. 3 shows a schematic, exploded view of the rotor and of the support of the rotor with the thrust-bearing as the previous figure but from a different angle.

Moreover, FIG. 2 shows the axial abutment 24 of the bush 8, which also has radial notches 25 and flattenings 26 on the external diameter thereof, to serve as anti-rotation halt with ears 27 which extend from the seat 6 of the bush-carrying disk 7. Obviously, nothing would prohibit to realize these radial notches 25 and flattenings 26 also on the magnet.

The advantages achieved by the present invention are multiple and they are hereafter listed.

The assembly represented by the electric motor 2 and by the pump 1 is much easier to construct, being it not provided with a component, exactly the thrust-bearing, which is no longer used.

Therefore, with the invention, remarkable economies of scale are obtained both in the production step, lower number of parts, and in the assembly step and in the following and possible maintenance step.

The sliding coupling between the abutment 24 of the bush 8 and the side of the rotor 15 allows a safe support of the axial thrust. Obviously, a technician in the field, will be able to bring several changes to the above described fluid circulation pump, in order to meet specific and contingent needs, all however within the scope of protection of the present invention as defined by the following claims.

All of the above U.S. patents, U.S. patent application publications, U.S. patent applications, foreign patents, foreign patent applications and non-patent publications referred to in this specification and/or listed in the Application Data Sheet are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A pump, comprising:

a permanent magnet electric motor having a stator, a permanent magnet rotor magnetically coupled to the stator, and a shaft coupled to the rotor, the permanent magnet rotor including a first permanent magnet;

an impeller coupled to the shaft so as to rotate with the shaft and rotor; and an impeller support structure;

a thrust-bearing rotation support that includes:

a hollow body that supports and contains the rotor; and first and second supports that support the shaft adjacent to opposite ends of the rotor, the first support providing axial thrust-bearing and including a bush of antifriction material facing a first end of the first permanent magnet of the rotor and having an axial abutment placed directly in contact with said first end of the first permanent magnet, the bush fixedly contacting the impeller support structure.

2. The pump of claim 1, wherein the rotor includes a second permanent magnet having an end that directly contacts the axial abutment of the bush.

3. The pump of claim 1, wherein the first permanent magnet is of magnetic ceramic material.

4. The pump of claim 1, wherein said bush has an external perimeter with flattenings that serve as an anti-rotation halt by contacting ears extending from a housing seat of a support disk that carries said bush, the support disk being part of the impeller support structure.

5. The pump of claim 1, wherein the bush has radial notches in said axial abutment.

6. A rotation support with improved thrust-bearing for a permanent magnet rotor of an electric motor of a pump, the electric motor having a stator and a shaft coupled to the rotor, the rotation support comprising:

a hollow body that supports and contains the rotor;

a pump support structure; and first and second supports that support the shaft adjacent to opposite ends of the rotor, the first support providing axial thrust-bearing and including a unitary bush of antifriction material facing a first end of the rotor, the bush fixedly contacting the pump support structure and having an axial abutment placed directly in contact with said first end of the rotor, wherein the bush has radial notches in said axial abutment.

7. The support according to claim 6, wherein the rotor includes permanent magnets having respective ends that emerge from the first end of the rotor and directly contact said bush.

8. The support according to claim 6, wherein the rotor includes permanent magnets of magnetic ceramic material.

9. The support according to claim 6, wherein said bush has an external perimeter with flattenings, the pump support structure further comprising a support disk having a housing seat and ears extending from housing seat, the ears contacting the flattenings to provide an anti-rotation halt.

10. A pump, comprising:

a permanent magnet electric motor having a stator, a permanent magnet rotor magnetically coupled to the stator, and a shaft coupled to the rotor;

an impeller coupled to the shaft so as to rotate with the shaft and rotor;

an impeller housing that houses the impeller; and a thrust-bearing rotation support that includes:

a hollow body that supports and contains the rotor; and first and second supports that support the shaft adjacent to opposite ends of the rotor, the first support being a unitary bush of antifriction material having a first axial abutment contacting the impeller housing to provide axial thrust bearing and a second axial abutment directly in contact with a first end of the rotor.

11. The pump of claim 10, wherein the rotor includes a permanent magnet having an end that directly contacts the second axial abutment of the bush.

12. The pump of claim 11, wherein the permanent magnet is of magnetic ceramic material.

13. The pump of claim 10, wherein the impeller housing includes a seat that carries said bush and ears that extend from the seat and wherein said bush has an external perimeter with flattenings that serve as an anti-rotation halt by contacting the ears extending from the impeller housing seat.

14. The pump of claim 10, wherein the second axial abutment has radial notches.

* * * * *